United States Patent [19]

Neau

[11] 4,165,095

[45] Aug. 21, 1979

[54] SELF RESTORING SAFETY SKI BINDING

[75] Inventor: Alain Neau, Thyez, France

[73] Assignee: The Garcia Corporation, Teaneck, N.J.

[21] Appl. No.: 863,437

[22] Filed: Dec. 22, 1977

[51] Int. Cl.[2] ..... A63C 9/08

[52] U.S. Cl. ..... 280/613; 280/637

[58] Field of Search ..... 280/619, 620, 621, 622, 280/637, 613

[56] References Cited

U.S. PATENT DOCUMENTS

| | | | |
|---|---|---|---|
| 3,998,473 | 12/1976 | Schmidt | 280/637 X |
| 4,026,577 | 5/1977 | Frechin | 280/637 X |

*Primary Examiner*—Joseph F. Peters, Jr.
*Assistant Examiner*—Gene A. Church
*Attorney, Agent, or Firm*—Fitzpatrick, Cella, Harper & Scinto

[57] ABSTRACT

A mechanism is provided for adjusting the effective length of the cable in a ski binding having a sole plate releasably secured to a ski by means of at least one tensioned cable. The adjustment mechanism comprises a rotatable support mounted on the ski to which an end of the cable is secured. The rotatable support includes a ratchet and pawl arrangement whereby the position of the end of the cable may be manually regulated.

6 Claims, 6 Drawing Figures

SELF RESTORING SAFETY SKI BINDING

BACKGROUND OF THE INVENTION

The present invention relates to safety ski bindings of the type, having a sole plate, to which a ski boot is releasably fastened, the sole plate being releasably secured to the ski at least at one of its ends, by at least one flexible cable subjected to the action of at least one elastic tension device; such bindings being commonly referred to as "retractable" bindings. More specifically, the invention relates to a mechanism for adjusting the effective length of the flexible cable, in order to insure proper positioning of the plate on the ski.

In known ski fastenings of this kind, the means for adjustment of the cable length are placed on the ski, behind the sole plate. It consists of a threaded rod, integral with the end of the flexible cable placed in a housing fastened to the ski. In the housing the screw can be axially displaced, but not rotated. A nut, situated outside the housing, is threaded on to the end of the screw, and by rotation, displaces the latter axially to move the end of the flexible cable. A problem associated with this construction is that it takes a relatively long time to make an adjustment, the adjusting nut having to make several turns for the whole range of adjustment to be covered. Furthermore, an accidental loosening of the nut, and, therefore, maladjustment of the length of the cable, is possible. A lock nut could, of course, be used, but then two different tools would have to be utilized or there would have to be at least several successive operations, such as unlocking of the lock nut, adjustment and relocking of the lock nut in order to adjust the effective length of the cable.

SUMMARY OF THE INVENTION

The adjustment mechanism of the present invention avoids the aforementioned detractions and yet is simple, is of few components, and permits adjustment over a wide range, practically instantaneously. Furthermore, the adjustment mechanism cannot be accidentally thrown out of adjustment and requires the use of only one tool, the adjustment being made in a single operation.

In accordance with the present invention, there is provided an improved means for adjusting the effective length of at least one cable in a retractable binding which comprises a support element rotatably mounted to the ski; said support element including means for fastening the end of said flexible connection, off center in relation to the axis of rotation, and having at least one shaped element, elastically mobile in relation to the support element, urged toward engagement with at least one of several teeth arranged on an element stationary in relation to the shaped element; means are provided, at least on the mobile shaped element to temporarily disengage the shaped elements whereby the support element, may be rotated to vary the length of said cable.

According to one embodiment of the invention, in which the front end of the sole plate engages a contoured part provided on a head pivotally mounted to the ski to rotate about an axis perpendicular to the surface of the latter, to which is coupled one end of the flexible cable subjected to the action of the elastic tension device housed within the sole plate, the support element is mounted so as to rotate in the pivoting head and the stationary shaped parts are integral with the pivoting head. According to another embodiment, the support element is mounted so as to rotate on the ski and the stationary shaped parts are integral with the ski.

In either of the foregoing embodiments of the invention, the support element is at least substantially circular on at least part of its periphery, and is mounted within a roughly circular housing which serves to center it and which is provided in the stationary element. The mobile shaped element of the support element comprises at least one pawl provided on part of the periphery of the support element elastically attached to the latter by a narrowed neck. The stationary elements of shape conjugated with that of the pawl, consist of a series of teeth provided on at least part of the inner wall of the circular housing. The means of disengagement and rotary drive comprises a raised or depressed stamping provided on the top of the pawl, or on each of the tops of the pawl and the support element itself. These means of disengagement are dimensioned to cooperate with any type of tool, for example, and preferably a screw driver.

According to another embodiment, the rotatable support element, which may be circular or noncircular, is pivoted on a shaft, and the mobile shaped element consists of at least one pawl hinged to the periphery of the support element. The pawl is continuously urged into engagement with one of a series of teeth arcuately arranged on the stationary element, by the tensioning effect of the cable. The means for disengagement and rotary drive consists of a raised or depressed stamping provided, either on the top of the pawl, or on each of the tops, of the pawl and on the support element itself as in the above-mentioned embodiment.

According to a variant applicable to the aforementioned embodiments, the means for fastening the end of the cable, off center in relation to the axis of rotation of the rotatable support element, consists of a notch, opening out on the periphery of the support element on at least part of the height of the latter, the bottom of which is approximately parallel to the axis of rotation of said support element and shaped to receive a stop element integral with the end of the cable. Two clearances approximately perpendicular to the axis of rotation of the support element are provided, one in the support element for passage of the part of the cable next to the stop element during the rotation of the support element; and the other in the stationary element, for passage of the part of the cable following that which is immediately next to the stop element.

There has thus been outlined rather broadly the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of other structures for carrying out the several purposes of the invention. It is important, therefore, that the claims be regarded as including such equivalent constructions as do not depart from the spirit and scope of the invention.

BRIEF DESCRIPTION OF THE DRAWINGS

Certain specific embodiments of the invention have been chosen for purposes of illustration and description, and are shown in the accompanying drawings, forming a part of the specification wherein.

DETAILED DESCRIPTION OF THE INVENTION

Figure 1:
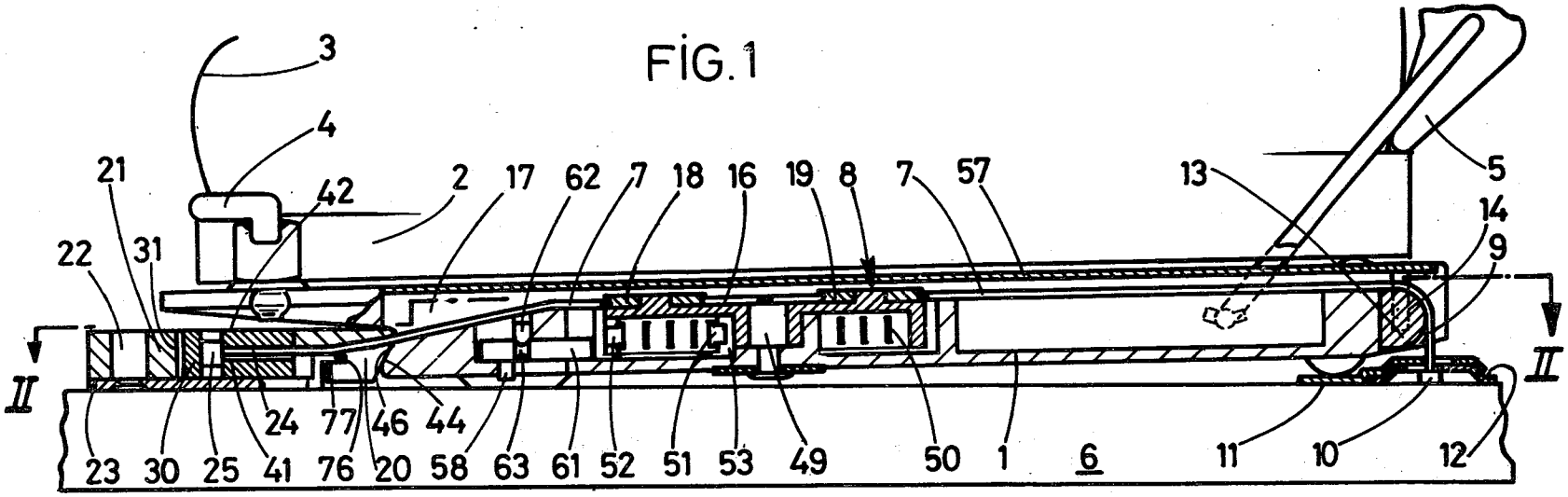
FIG. 1 is a longitudinal cross-section taken along I—I of FIG. 2, illustrating a ski binding including a first embodiment of the invention.

With reference to FIGS. 1 to 4, a ski binding to which the invention pertains comprises a sole plate 1 to which the sole 2 of a boot 3 is fastened by a front check element 4 and by a back check element 5. Sole plate 1 is continuously urged toward bearing on a ski 6 by a flexible cable 7 subjected to the action of an elastic tension device 8. The rear end 9 of cable 7 has a stop element 10 which is retained in a base plate 11 secured to ski 6. A rotating element 2 permits engagement or release of stop element 10 under base plate 11 so that the cable may be intentionally disconnected from the ski. Cable 7 passes into the recess of a return element 13, which is, for example, maintained in position in plate 1 by two lugs 14. Cable 7 is then wound, approximately 180° successively, around two pulleys 18 and 19 rotatably mounted on a drum 16 by two diametrically opposite shafts. Cable 7 then passes between the two walls of a stationary guide 17 provided along the longitudinal axis of plate 1, substantially at the front end thereof, and then crosses a clearance 20 and under a head 21 mounted to pivot on ski 6 about a vertical shaft 22 secured to the ski 6 by means of a base plate 23. Cable 7 terminates at its front end 24, with a stop element 25 which is coupled to a section of head 21.

The section of head 21 of which cable 7 is connected comprises a support element 30, having a substantially circular periphery, set in a circular housing 31 provided in head 21. Housing 31 serves to center support element 30 for rotation therein. The housing 31 includes over approximately 180° of interior surface, a series of spaced teeth 32, as well as an additional tooth 33 spaced apart from the others. Support element 30 includes a pawl 34, of shape conjugated with that of teeth 32 and 33. Pawl 34 is formed on an element 35 attached to the periphery of support 30 by a neck 36. When support element 30 is in place in housing 31, pawl 34 is slightly displaced inwardly and these tends to be elastically urged into one of teeth 32 or 33.

Support element 30 further includes a notch 37 opening out on the periphery of said element 30. The closed end 38 of notch 37 is roughly parallel to the vertical axis of rotation of support element 30 and is shaped to receive stop element 25. When the latter is lodged therein, it is off center in relation to the axis of rotation of support 30. A clearance 41 is machined into element 30 perpendicular to the axis of rotation of the support element 30 for free travel of the end 24 of cable 7, preceding element 25, during the rotation of support element 30.

On the upper face 42 of support element 30, and particularly element 36, a depressed stamping 40 is formed which is dimensioned to receive the blade of a screw driver.

When sole plate 1 is in position on ski 6, two inclined front parts 43 and 44 of plate 1 are in contact respectively with two oppositely inclined faces 45 and 46 provided at the back of head 21.

Drum 16, forming part of the elastic tension device 8, includes, on its periphery, a V-notch 64, designed to work together with a roller 65 pivoted on a sliding push rod 66. Push rod 66 is urged in the direction of arrow 67 by a compression spring 68. An adjustment screw 60 which is accessible from the outside of plate 1, allows for displacement of nut 70 axially to adjust the tension of spring 68. The axial position of nut 70 can be marked through a window 71 provided in the side wall of plate 1. On the other hand, a mark 74 is placed on the outer periphery of drum 16, opposite a second window 75 machined in plate 1. Notch 64 and roller 65 work together to block the rotation of drum 16 but to permit rotation upon application of a predetermined separation force between plate 1 and ski 6. The separation force can be regulated by screw 69. When the predetermined force is exceeded, faces 43 and 44 are separated from faces 45 and 46, either laterally by simultaneously rotating head 21, or vertically, and plate 1 is separated from its rest position on ski 6 (FIG. 1). An arc-shaped flange 76, provided at the back of plate 23, is lodged in a groove 77 of corresponding shape, provided under the back part of head 21 in order to keep the latter constantly in position close to the ski and to prevent any vertical travel.

Elastic tension device 8 also includes, inside drum 16, a spiral spring 50, the inner end 51 of which is connected to an opening 53 integral with plate 1. Drum 16 is pivoted on a vertical shaft 49 integral with plate 1. The other end 52 of spring 50 is connected to the inner wall of drum 16. Spiral spring 50 constantly urges drum 16 to rotate in the direction of arrow 56. Drum 16 and pulleys 18 and 19 thus keep cable 7 taut, which tends to keep plate in skiing position on ski 6, faces 43 and 44 then being locked under faces 45 and 46. After abatement of a force causing separation of plate 1 from ski 6, spring 50 rotates drum 16 to retract cable 7 and cause plate 6 to resume the skiing position on ski 6.

A notch 59, machined on the outer surface of drum 16, is designed to be engaged, after a certain voluntary rotation of drum 16 in the direction of arrow 60, by a bolt 61 slidably mounted in plate 1. Bolt 61 can be manually lodged in notch 69 by means of a lug 58. An elastomeric stop element 62, integral with plate 1, can be inserted into recess 63 or bolt 61, in order to maintain bolt 61 out of engagement with notch 59. A top plate 57 closes the housing of plate 1, containing the entire elastic tension device 8.

In order to secure stop element 25 of cable 7 to head 21, it is first necessary to cancel the action of elastic tension device 8 on cable 7. For such purpose, drum 16 is rotated manually in the direction of arrow 60 until the drum is brought into the position represented on FIGS. 3 and 4. In that position notch 59 is opposite bolt 61; and as shown in the figures, bolt 16 has been manually inserted into notch 59. In such position no tension is placed on cable 7.

Figure 3:
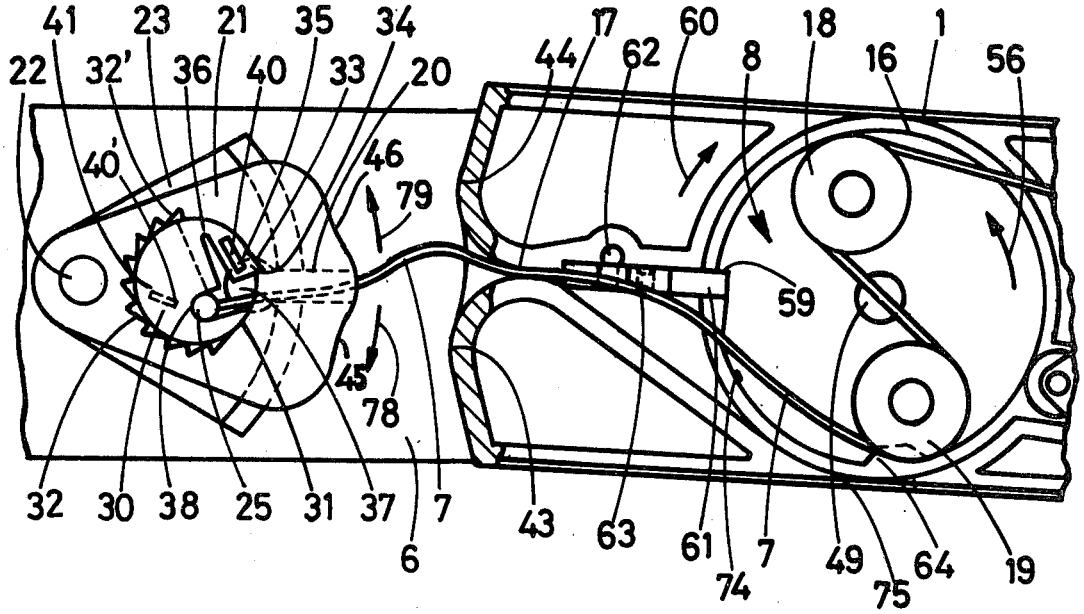
FIGS. 3 and 4 are partial cross-sectional views taken along II—II of FIG. 1 illustrating the first embodiment of the invention in various positions.

It is then necessary to bring support element 30 into the position represented in FIG. 3. For that purpose, a screw driver blade is inserted in depressed stamping 40 and twisted in the direction of arrow 78. This has the effect of bending part 35 toward element 30 until pawl 34 escapes tooth 32. The support element 30 then turns by itself in the direction of arrow 78 until pawl 34 is elastically lodged in tooth 33 of pivot head 21 (FIG. 3). In that position, notch 37 is placed approximately in the extension of clearance 20 in head 21. Stop element 25 is then placed at the end 38 of notch 37 after passage through clearance 20.

Figure 4:
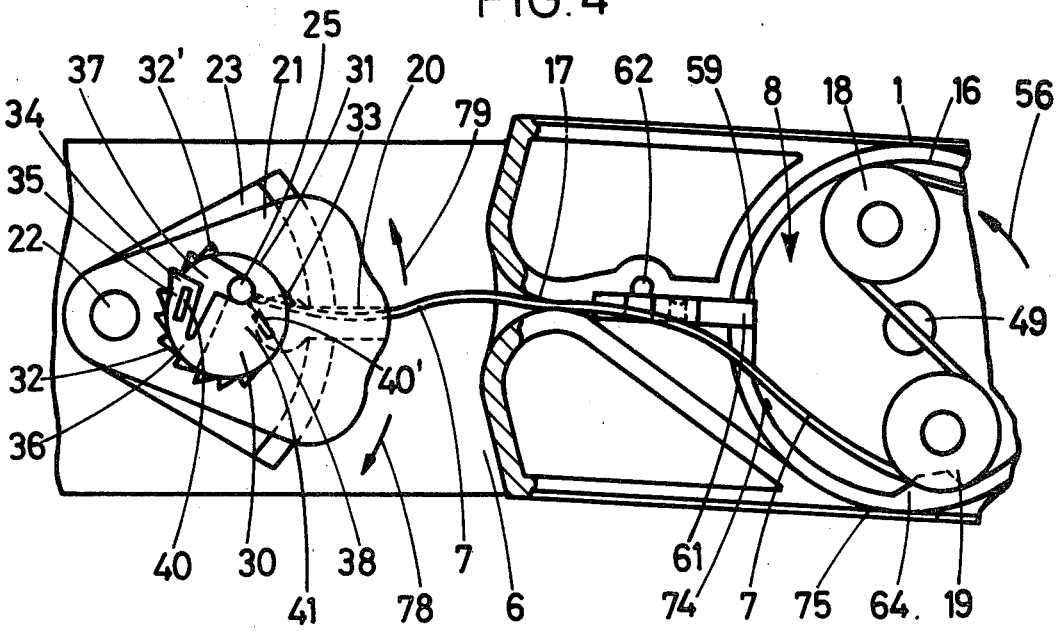

Support element 30 is then rotated by means of the screw driver, in the direction of arrow 79 until its pawl 34 is engaged with tooth 32' (FIG. 4). In that position, stop element 25 is in its closest position to elastic tension device 8 and the rotation of notch 37 has been sufficient for stop element 25 to be locked in notch 37. The actual adjustment of the position of stop element 25 and, therefore, of the useful free length of cable 7 is then possible by continued rotation of support element 30 in the direction of arrow 79, to progressively increase the distance between stop element 25 and elastic tension device 8 and thus shortening the free length of cable 7. The different elements are thus, for example, in an intermediate position, as represented on FIG. 4.

Figure 2:
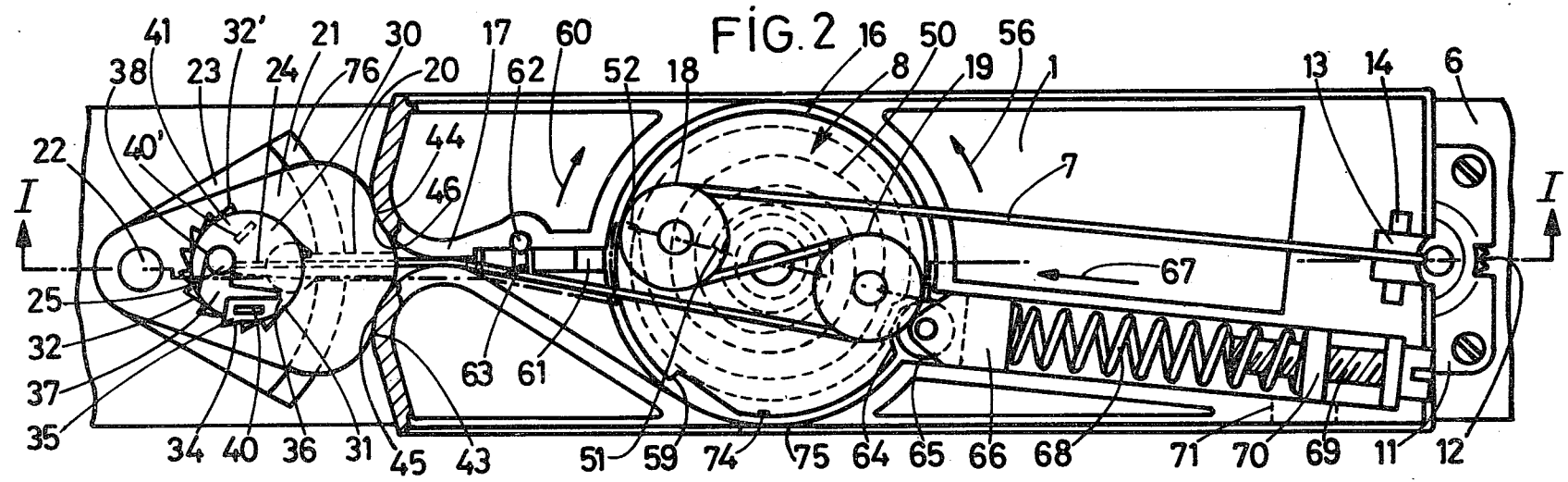
FIG. 2 is a cross-sectional view taken along II—II of FIG. 1.

To check whether the useful length of the cable 7 is correct, it is sufficient to move back bolt 61 and free drum 16, which automatically returns elastically to the FIG. 1 position. The adjustment should be considered correct when mark 74 on drum 16 is positioned opposite window 75. In such position, the useful length of the cable is correct and sole plate 1 will be maintained, without undue play, on ski 6. It can also be concluded from this that notch 64 is correctly positioned at an angle in relation to roller 65. If the adjustment is not correct, it is necessary only to relock bolt 61 in notch 59 and to turn support element 30 in the desired direction. In FIGS. 1 and 2, support element 30 is represented in a position corresponding roughly to its extreme adjustment position.

The direction of teeth 32 firmly opposes any unwanted rotation of support element 30 in the direction of arrow 78 and, therefore, the relaxation of cable 7 during use of the binding. Likewise, when plate 1 is separated from ski 6, such as when the skier falls, any rotation of support element 30 in the direction of arrow 79 is prevented by elastic pawl 34. The free useful length of cable 7 can thus, in no case, be thrown out of adjustment, while being very rapidly readjusted again on a change of cable, for example.

According to a variant to the above embodiment, a second depressed stamping 40' is provided on the upper face of support element 30 proper. It is also designed to receive the blade of a screw driver. Stamping 40' is designed to rotate support element 30 more easily in the direction of arrow 79, and stamping 40 is designed to rotate the latter in the direction of arrow 78.

Figure 5:
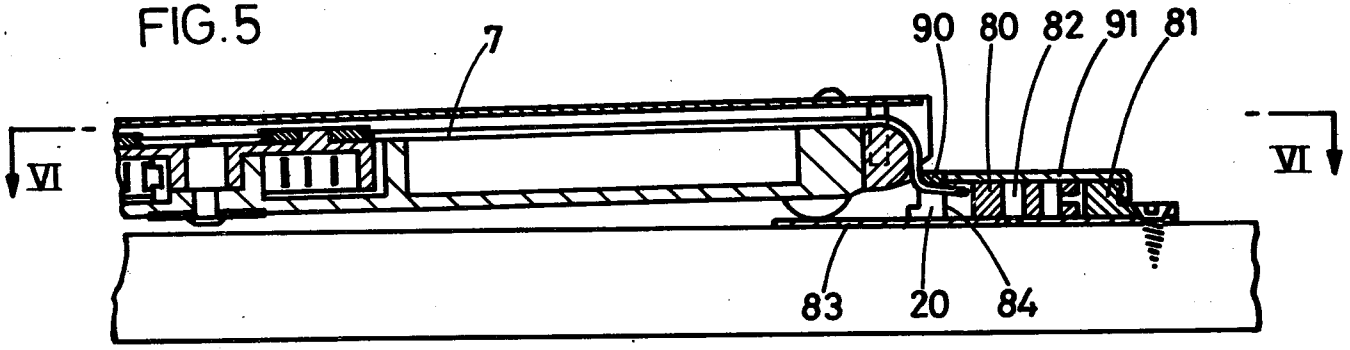
FIG. 5 is a partial longitudinal cross-section taken along V—V of FIG. 6, illustrating a second embodiment of the invention.
Figure 6:
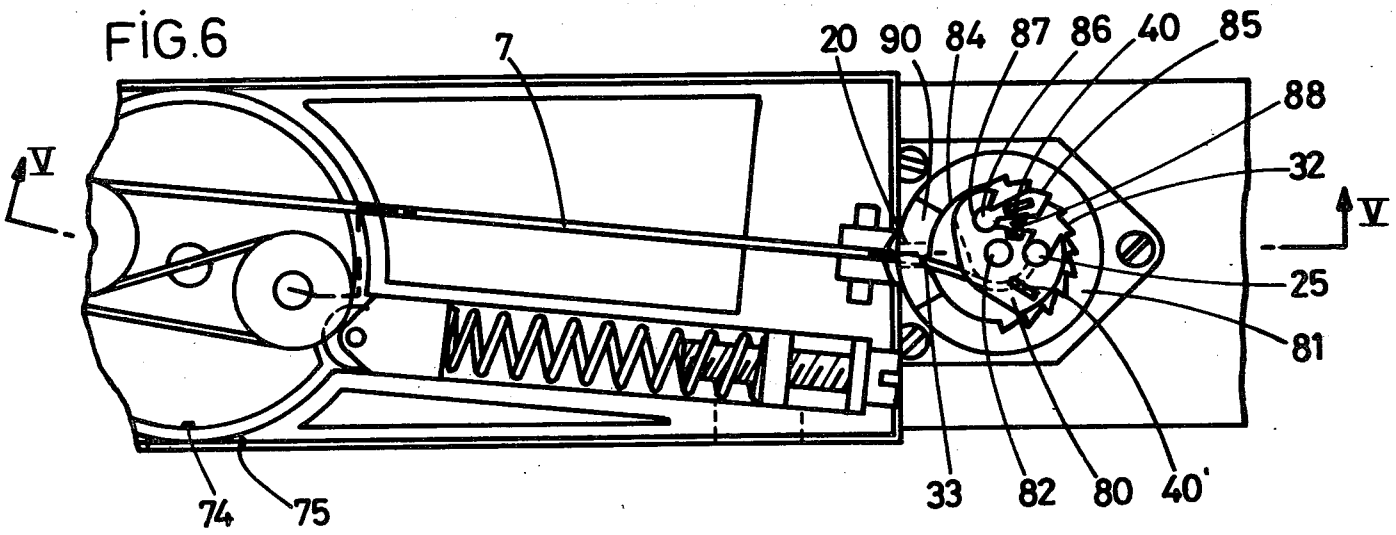
FIG. 6 is a partial sectional view taken along VI—VI of FIG. 5.

In a second embodiment, represented on FIGS. 5 and 6, rotating support element 30, situated in head 21, is eliminated and replaced by a support element 80 mounted so as to turn on a base plate 81, which replaces base plate 11 of the first embodiment. Base plate 81 is secured to the ski 6 such as by screws behind sole plate 1. Support element 80 is pivoted on a vertical shaft 82 integral with a small plate 83 maintained under base plate 81 in an approximately circular housing 84. Housing 84 contains, over approximately 180° of its inner wall, teeth 32 as well as an additional tooth 33 spaced apart from the others. Support element 80 includes a pawl 85 of shape conjugated with that of teeth 32 and 33. In this embodiment pawl 85 is hinged at 85, for example, by an enlarged end, which is placed in a partially circular housing 87 provided in support element 80. A helical spring 88 urges pawl 85 toward teeth 32 or 33. A clearance 20 is also provided in base plate 81 just below a bridge-shaped part 90, against which cable 7 is supported. A cover 91 (FIG. 5) goes over the entire device. All of the other elements are identical to those of the first embodiment previously described. The operation of the unit is similar.

Those skilled in the art will readily appreciate that the present invention is applicable to all ski bindings which utilize a tensioned return cable.

What is claimed is:

1. In a ski binding comprising a sole plate, at least one flexible cable connecting an extremity of said sole plate to a ski and at least one elastic tension device housed within said sole plate and associated with said flexible cable to place a continuous tension thereon for releasable retaining said plate on said ski; an improved cable length adjustment which comprises:

means defining a housing secured to the surface of said ski adjacent an end of said sole plate;

a support element rotatably mounted within said housing, said support including means for securing an end of said cable thereto off center in relation to the axis of rotation thereof, said support further including pawl means elastically urged toward the inner wall of said housing;

a series of teeth arranged on said inner wall of said housing, said teeth being arcuately arranged for engagement by said pawl means; and means arranged on at least said pawl means for manually disengaging said pawl means from one of said teeth whereby said support may be manually rotated to alter the effective length of said cable.

2. A ski binding according to claim 1 wherein said means defining a housing comprises a head pivotally secured to said ski in front of said plate, the rearward end of said head being contoured to engage a contoured area at the front of said sole plate.

3. A ski binding according to claim 1 wherein said means defining a housing is secured to said ski adjacent the rear end of said sole plate; and said support is rotatable in said housing about an axis perpendicular to the surface of said ski.

4. A ski binding according to claim 2 wherein said housing defines a substantially circular recess dimensioned to receive and center said support for rotation about an axis perpendicular to the surface of said ski.

5. A ski binding according to claim 1 wherein said pawl means is articulated to said support and is elastically urged toward said inner wall by a spring arranged between said pawl and said support.

6. A ski binding according to claim 1 wherein said means arranged on at least said pawl means for disengaging said pawl comprises an indentation on the top surface thereof dimensioned to receive the blade of a screw driver.

* * * * *